US006273170B1

(12) United States Patent
Finn et al.

(10) Patent No.: US 6,273,170 B1
(45) Date of Patent: Aug. 14, 2001

(54) LABEL SHUTTLE AND CLAMP BAR ASSEMBLY FOR A LABEL PLACEMENT MACHINE

(75) Inventors: Daniel C. Finn, Valley Center; Jerome Leonard Weber, Escondido, both of CA (US)

(73) Assignee: Amistar Corporation, San Marcos, CA (US)

( * ) Notice: Subject to any disclaimer, the term of this patent is extended or adjusted under 35 U.S.C. 154(b) by 0 days.

(21) Appl. No.: 09/324,362

(22) Filed: Jun. 2, 1999

(51) Int. Cl.[7] ..... B65C 9/00; B65C 9/18; B65C 9/26

(52) U.S. Cl. ..... 156/542; 156/541; 156/DIG. 33; 156/DIG. 37

(58) Field of Search ..... 156/542, 541, 156/540, DIG. 24, DIG. 28, DIG. 33, DIG. 37, 556

(56) References Cited

U.S. PATENT DOCUMENTS

| | | | |
|---|---|---|---|
| 4,390,390 | 6/1983 | Margraf et al. | 156/566 |
| 4,857,121 | 8/1989 | Markley et al. | 156/64 |
| 4,927,486 | 5/1990 | Fattal et al. | 156/351 |
| 5,078,816 | 1/1992 | Ratermann | 156/64 |
| 5,141,572 | 8/1992 | Gerber | 156/64 |
| 5,158,640 * | 10/1992 | Akiyama | 156/542 |
| 5,230,765 | 7/1993 | Weiselfish et al. | 156/350 |
| 5,236,535 | 8/1993 | Smith | 156/250 |
| 5,250,138 | 10/1993 | Szewczyk et al. | 156/350 |
| 5,370,754 * | 12/1994 | Soloman | 156/64 |
| 5,427,029 | 6/1995 | Dumke | 101/484 |
| 5,435,862 | 7/1995 | Williams et al. | 156/64 |
| 5,472,552 | 12/1995 | Speranza et al. | 156/351 |
| 5,674,335 | 10/1997 | Aman et al. | 156/64 |
| 5,705,021 | 1/1998 | Wurz et al. | 156/360 |
| 5,733,410 | 3/1998 | Gore et al. | 156/556 |

* cited by examiner

*Primary Examiner*—Richard Crispino
*Assistant Examiner*—Sue A. Purvis
(74) *Attorney, Agent, or Firm*—Gray Cary Ware Freidenrich

(57) ABSTRACT

A label placement machine used for placing labels on articles, the label placement machine including a label supply having one or more labels, a label shuttle assembly capable of retrieving a label from the label supply and transporting the label from the label supply to a pickup zone and a label placement head retrieving the label from the label shuttle at the pickup zone and transporting the label from the pick up zone to the article to be labeled, the label placement head then attaching the label to the article while the label shuttle returns to the label supply to retrieve another label.

20 Claims, 12 Drawing Sheets

LABEL SHUTTLE AND CLAMP BAR ASSEMBLY FOR A LABEL PLACEMENT MACHINE

BACKGROUND OF THE INVENTION

1. Field of the Invention

This invention relates generally to automated labeling equipment for labeling articles, and more particularly to a label placement machine that includes a label shuttle and clamp bar assembly, and most particularly to a label placement machine in which the label shuttle transports the printed label from a label supply area to a label applicator head retrieval area.

2. Discussion of the Related Art

The application of labels to articles and products has been and continues to be an important step in providing pertinent information about the article or product. Manufacturers of various products are continually seeking a more efficient manner in which to apply labels to articles or items, such as printed circuit boards, cartons, containers or any other packages or products having a surface capable of securely receiving an adhesive label.

Various methods have been employed in the past to mark articles, most traditionally by manual application of stickers or labels. The introduction of adhesive backed pressure sensitive labels and hand-held, manually operated applicators has greatly facilitated the marking of articles by providing a simple means for applying an adhesive-backed label to an article. Such manual application of labels is well known and used extensively. Their use, however, in manufacturing, assembling and distributing applications is limited because of the necessity for marking articles at high speed. In these applications, the articles to be labeled are transported along a conveyor belt past a numbers of stations, one of which often entails the application of a label to each article as it passes by or while the conveyor belt is stopped. Manual application of labels in this high-speed operation is unacceptably slow, inefficient, labor intensive and therefore, impractical due to the time constraints associated with high volume production.

As a result, automated labeling machines have been developed to apply labels to articles advancing by a labeling station on, for example, a conveyor belt. The pressure-sensitive labels are commonly precut and carded on a continuous web of material, often called a backing material, which is rolled into a roll for mounting on the labeling machine. The backing material is somewhat more flexible than the label itself. This allows the label to be separated from the backing material simply be bending the backing material sharply away from the label, which is usually done by drawing the backing over a fairly sharp stripping or peeling edge of a peel blade or plate. The less flexible label then separates from the backing material.

One type of labeling machine includes the use of a movable label applicator assembly for acquiring the label from the peel blade, moving transversely across the conveyor away from the peel blade and applying the label to the article. One of the problems that have been encountered is the accuracy of the label placement on the article. The placement of the label on the label applicator assembly usually varies each time the applicator assembly acquires the label in the dispensing position. Each label that goes over the peel blade may release slightly differently from the backing material. This may skew the label when it is dispensed onto the receiving surface of the label applicator assembly. It has also been found that during movement of the label applicator assembly from the dispensing position to the article, the label often inadvertently moves relative to the receiving surface due machine vibration, abrupt movements and inertial and wind forces on the label. This inadvertent movement of the label during retrieval and movement of the label applicator assembly is even more a problem in high speed operations and results in unpredictable label positioning and label orientation on the article. Consequently, the location and orientation of the label on the article may be undesirable and unacceptable. Moreover, these types of machines often require the label applicator assembly to move through a delivery stroke from the peel blade and a return stroke back to the peel blade for each dispensed label, thereby expending a significant amount of operating time for each label. This unnecessarily large amount of operating time per label makes it more difficult to obtain the high speed labeling desired in present applications.

Nevertheless, industry demand for increased productivity continues to generate a need for higher speeds of operation. In most modem automated facilities, the placement of labels is the most time consuming. Instead of making label placement movements singly, in successive steps, it would be convenient, and faster, to make two or more movements simultaneously, to save valuable time. Furthermore, there is a need for accurate placement of labels on articles. In such cases, the label placement machine must be able to accommodate rapid changes not only label placement, but label types and sizes. It should therefore be clear that an accurate and reliable label placement machine that places labels quickly and accurately on an article would constitute a significant advance in the art.

SUMMARY OF THE INVENTION

In general, in one aspect, the invention features a label placement machine used for placing labels on articles, the label placement machine having a label supply with one or more labels, a label shuttle assembly capable of retrieving a label from the label supply and transporting the label from the label supply to a pickup zone, and a label the label placement head placement head retrieving the label from the label shuttle at the pickup zone, and the label placement head transporting the label from the pick up zone to the article to be labeled, the label placement head then attaching the label to the article.

Embodiments of the invention may include one or more of the following features. A clamp bar assembly positioned near the label supply, the clamp bar assembly applying pressure to an upper surface of the label with a spring loaded clamp bar, the label shuttle assembly approaching the label from a position below the label to a position above the label whereby the clamp bar assembly assists the label shuttle assembly in the retrieval of the label (i.e., grabs the label) from the label supply. A lifter bumper may be incorporated to disengage the clamp bar assembly after retrieval of the label. The label supply may include a label printer. The label may be preprinted. The label may be supplied on liner tape. A peel blade may be used to partially separate the label from the liner tape. The label shuttle assembly positioned below the partially separated label and the clamp bar assembly positioned above the partially separated label may work together to remove the label from the liner tape in an upward motion by the label shuttle. A conveyor system may be used to transport the articles through the label placement machine with the label pickup zone being located near a side of the conveyor system. The label placement head may use vacuum pressure to remove the label from the label shuttle assembly.

In general, in another aspect, the invention features a method of using a label placement machine to apply labels to an article, the method including providing one or more labels in a label supply area and partially separating the label from a liner tape thereby partially exposing an adhesive surface of the label. Positioning a label shuttle near the adhesive surface of the label and positioning a clamp bar assembly opposite the adhesive surface of the label, moving the label shuttle to contact the adhesive surface of the label, releasably attaching the adhesive surface to the label shuttle. The label shuttle then moving the label into contact with the clamp bar assembly, the clamp bar assembly supplying an opposing pressure force to assist in fully separating the label from the liner tape. Then disengaging the opposing pressure force of the clamp bar assembly from the label and moving the label shuttle away from the label supply area to a pickup zone. Removing the label from the label shuttle at the pickup zone with a label applicator head and moving the label applicator head to the article to be labeled and attaching the label to the article with the label applicator head Embodiments of the invention may include one or more of the following. A lifter bumper may be positioned on the label shuttle that engages and moves the clamp bar assembly away from the label. The labels may be preprinted. An onboard printer may be used to print the labels. A conveyor may be used to convey the articles to the label placement machine. The label shuttle returns to the label supply to retrieve another label at the same time the label applicator head moves to the article to attach the label, thereby saving time.

In general, still another aspect, the invention features a method of using a label shuttle assembly and clamp bar assembly with an existing label placement machine for attaching a label to an article, the existing label placement machine having a label supply and a label placement head, the method including positioning the label shuttle assembly on the label placement machine, the label shuttle assembly including a movable label shuttle and a clamp bar assembly, retrieving a label from the label supply area with the label shuttle and clamp bar assembly and moving the label with the label shuttle to a label placement head pickup zone. The label placement head retrieving the label from the label shuttle and moving the label to the article to be labeled, returning the label shuttle to the label supply while the label placement head attaches the label to the article, retrieving another label from the label supply with the label shuttle and clamp bar assembly while the label placement head attaches the label to the article and moving the label shuttle with the another label to the pickup zone.

The novel and unobvious features are set forth with particularity in the appended claims. This invention, both as to its organization and manner of operation and use, together with other objects, and advantages than those set forth above, may be best be understood with reference to the following description taken in conjunction with the accompanying drawings.

DETAILED DESCRIPTION OF THE PREFERRED EMBODIMENTS

Figure 1A:
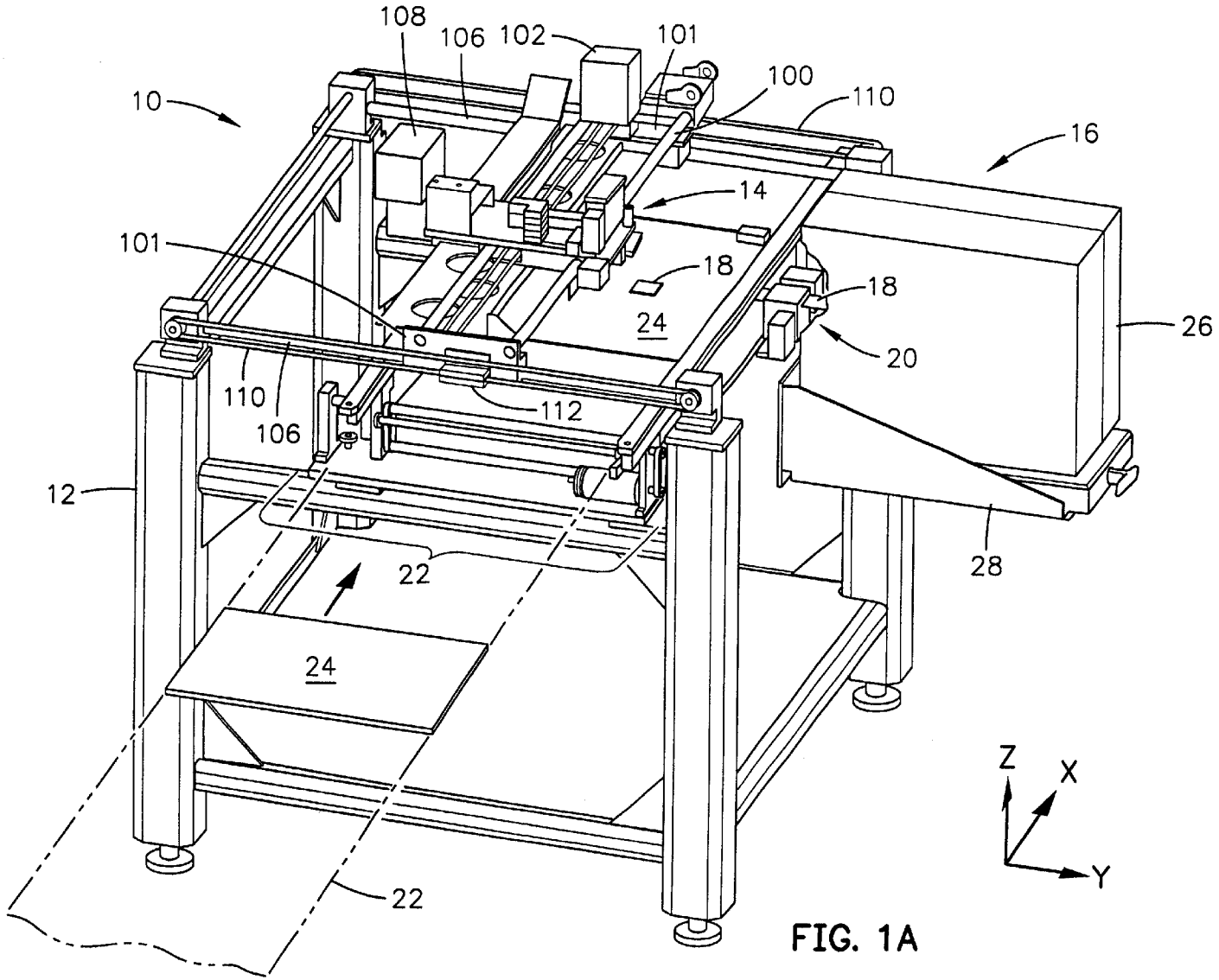
FIGS. 1A & 1B are prospective views of a label placement machine incorporating one embodiment of the label shuttle and clamp bar assembly of the present invention.
Figure 1B:
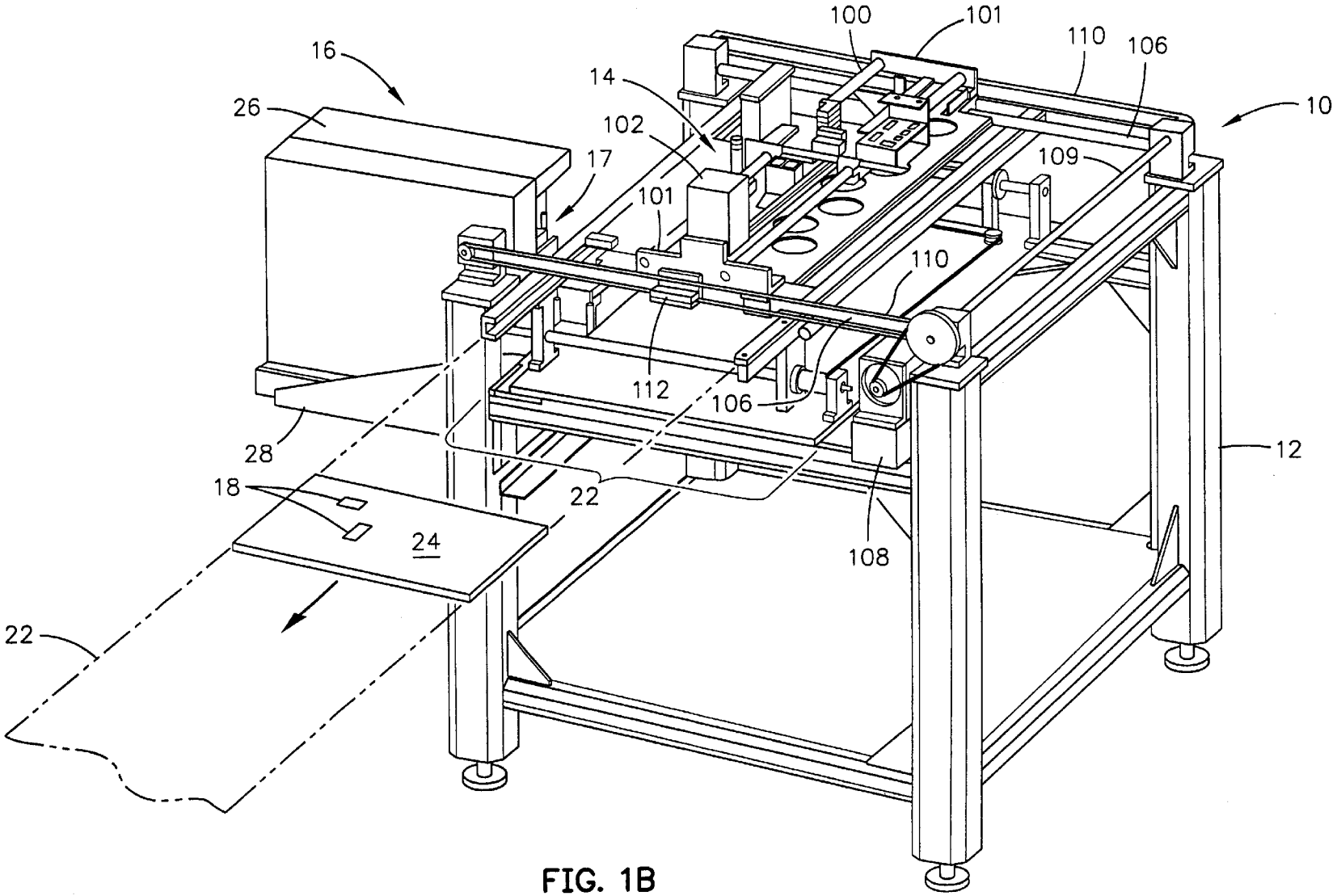

Referring now to the drawings, and more particularly to FIGS. 1A & 1B, there is shown a label placement machine 10 including a frame 12, one or more label placement heads 14, a label supply 16 with labels 18 and a label shuttle assembly 20 with a clamp bar assembly 42. The label placement machine 10 or DataPlace machine is used for placing labels 18 on articles of manufacture 24 (or substrates) before, during or after assembly. The labels 18 may include bar code labels, preprinted labels or specialty labels. In the preferred embodiment, the labels 18 are supplied on a backing material or backing tape 58 with the lower side of the label having a pressure sensitive adhesive to attach the label 18 to the article 24. The frame 12 is sized to receive the article 24 to be labeled and supports the one or more label placement heads 14, label shuttle assembly 20, label supply 16 and any other equipment required, such as an onboard label printer or computer. The label supply 16 is positioned on a side of the frame 12 of the label placement machine 10. The labels 18 may be preprinted on a role or the label supply may include a printer 26 capable of printing the labels 18 as needed. The printer 26 maybe positioned on a tray or support 28 on the operators side of the label placement machine 10. The label placement machine 10 is compatible and adaptable to current, high speed printers. In the preferred embodiment, a conveyer system 22 runs through the frame 12 carrying the article 24 to be labeled.

During operation, the label shuttle assembly 20 retrieves a label 18 from the label supply 16 and transports it to a pick up zone where it is retrieved by the label placement head 14. The label placement head 14 takes the label from the label shuttle assembly 20 and moves toward the article 24 to be labeled. At the same time, the label shuttle assembly 20 goes back to the label supply 16 and retrieves another label 18 and returns. Once the label placement head 14 has placed the label 18 on an article 24, it returns to the pick up zone where it retrieves the next label 18 from the label shuttle assembly 20. This process is then repeated. Use of the label shuttle assembly 20 eliminates the need for the label placement head 14 to retrieve label 18 directly from the label supply 16, thereby saving time.

Due to different label sizes and label adhesive strengths, the labels 18 may not separate consistently from the backing tape when the label shuttle assembly 20 removes them from the backing tape. This label separation inconsistency means that when the label shuttle assembly 20 retrieves the label 18, the label 18 placement on a label transfer pad 38 of the label shuttle assembly 20 may vary, thereby reducing the accuracy of the label placement machine 10. To reduce label separation inconsistency and improve the accuracy of label placement machine 10, a clamp bar assembly 42 may be used in conjunction with the label shuttle assembly 20 to consistently remove and position the label 18 in a preferred position on the label transfer pad 38 of the label shuttle assembly 20. The clamp bar assembly 42 is positioned immediately above a partially separated label 18 in the label supply area 16 (this will be shown in more detail below). The clamp bar assembly 42 has a spring loaded clamp bar 48 position above the label 18 such that while the label transfer pad 36 contacts the label 18 from below, a slight pressure force is provided on top of the label 18 from the spring loaded clamp bar assembly 44. The clamp bar 48 and label transfer pad 36 "grab" the label 18 and consistently remove the label 18 from the backing tape 58. As the label transfer pad 36 continues upward, the clamp bar 48 is disengaged from the label 18 so that the label shuttle assembly 20 can move away without the pressure of the clamp bar 48 on the label 18. The label shuttle assembly 20 then moves from the label supply 16 to the edge of the conveyor system (i.e. pick up zone), where the label placement head 14 removes the label 18 from the label transfer pad 36. The label shuttle assembly 20 then lowers and returns to the label supply 16 to retrieve another label 18.

Figure 2:
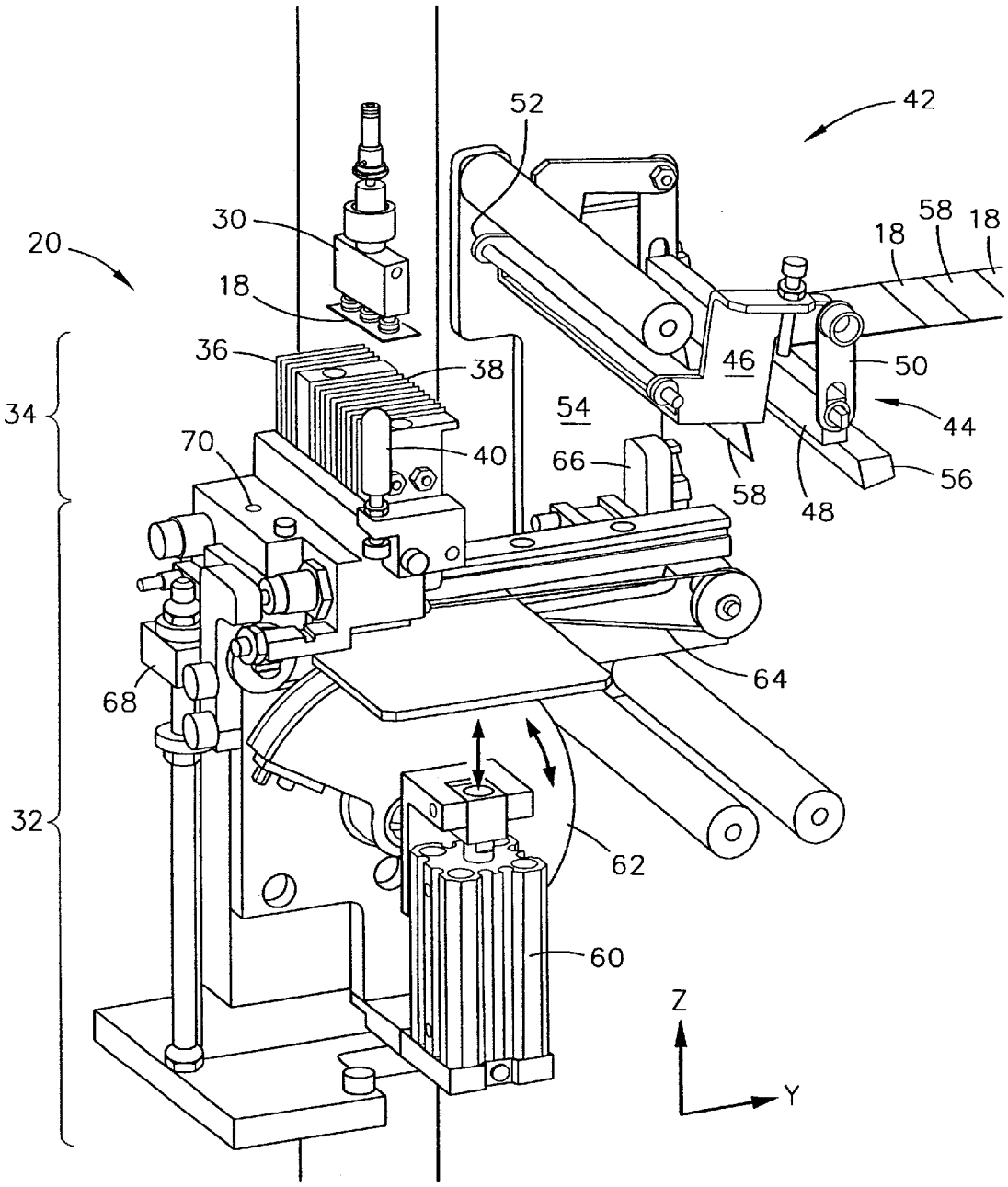
FIG. 2 is a perspective view of the label shuttle and clamp bar assembly of the label placement machine shown in FIG. 1.

FIG. 2 shows one embodiment of the label shuttle assembly 20 used in a label placement machine 10. The label shuttle assembly 20 is an intermediate device that retrieves the label 18 from the label supply 16 (i.e., printer or preprinted label supply) and transports the label 18 to the pickup zone, where it is retrieved by the label placement head 14. The label placement head 14 includes one or more label applicators 30 (only one is shown in the figure) that picks the label 18 up from the label shuttle assembly 20 and applies the label 18 to the article 24. The label shuttle assembly 20 includes a label shuttle mechanism 32 that includes actuators, pulleys, cables and other components that move a label shuttle 34 in a back and forth motion to retrieve the label 18 (which will be described below and shown in FIGS. 3A–3H). The label shuttle 34 includes a label transfer pad 36 and a lifter bumper 40. In the preferred embodiment, the label transfer pad 36 has an upper surface made of a material having a plurality of edges or ridges that engage the label 18 (i.e., the adhesive portion of the label will releasably attach to the edges or ridges of the label transfer pad). The label shuttle 34 moves the label 18 between the label supply 16 and a predefined pickup zone 17 (typically in the +/−y direction). This pickup zone 17 is conveniently located somewhere between the article 24 to be labeled and the label supply 16, to reduce the length of travel necessary for the label placement head 14. The label transfer pad 36 is also able to move up and down so that it comes up from underneath the label 18 to remove the label 18 from the backing tape 58 (in the +/−z direction), this will be described in more detail below. The movement distance of the label shuttle 34 in both the y and z direction is adjustable to allow for optional printers 26 and printer locations and optional pickup zone locations.

The label shuttle 34 and label shuttle mechanism 32 are capable of moving back and forth (in the +/−y direction) and up and down (in the +/−z direction). FIG. 2 shows some of the components associated with this movement. The back and forth movement is controlled using an air cylinder 60 and drive pulley 62. Cables 64 are attached between the drive pulley 62 and the label shuttle 34 (see FIG. 3A). As the air cylinder 60 is raised and lowered, the drive pulley 62 is rotated and pulls on the cable 64. Depending on which direction the drive pulley 62 is rotated, the cable 64 moves the label shuttle 34 back and forth (+/−Y direction). At the end of the back or forth stroke are stop blocks, a front stop block 66 and a rear stop block 68. The front stop block 66 controls the position of the label shuttle 34 in relation to the label supply 16 or printer 26. The rear stop block 68 controls the position of the label shuttle 34 (and printed label 18) in relation to the pick up zone for the label applicator 30. To prevent hard stops, which might dislodge the label 18 on the label shuttle 34, small shock absorbers 70 are located on the label shuttle 34. The shock absorbers 70 cushion the label shuttle 34 as it reaches the end of the back or forth stroke against the stop blocks. Actuators may be used to move the label shuttle 34 up or down.

Referring again to FIG. 2, a clamp bar mechanism 42 may be used in combination with the label shuttle 34. The clamp bar mechanism 42 includes the spring loaded bar assembly 44 that is attached to a clamp bar lifter 46. The spring loaded bar assembly 44 includes a clamp bar 48 that is sidably connected to clamp bar links 50. The clamp bar lifter 46 is rotatably hinged 52 to mounting plates 54 (only one mounting plate is visible in figures with the near mounting plate removed for clarity). The clamp bar lifter 46 is capable of pivoting between a lowered position and a raised position. A spring is used to bias the clamp bar 48 in a lowered position in the clap bar links 50. Also shown is the label peel blade 56. The labels 18 are positioned on backing tape 58. As the backing tape 58 is moved over the peeler bar 56 and then pulled at an angle (see FIG. 3B), the labels 18 separate from the backing tape 58.

Figure 3:
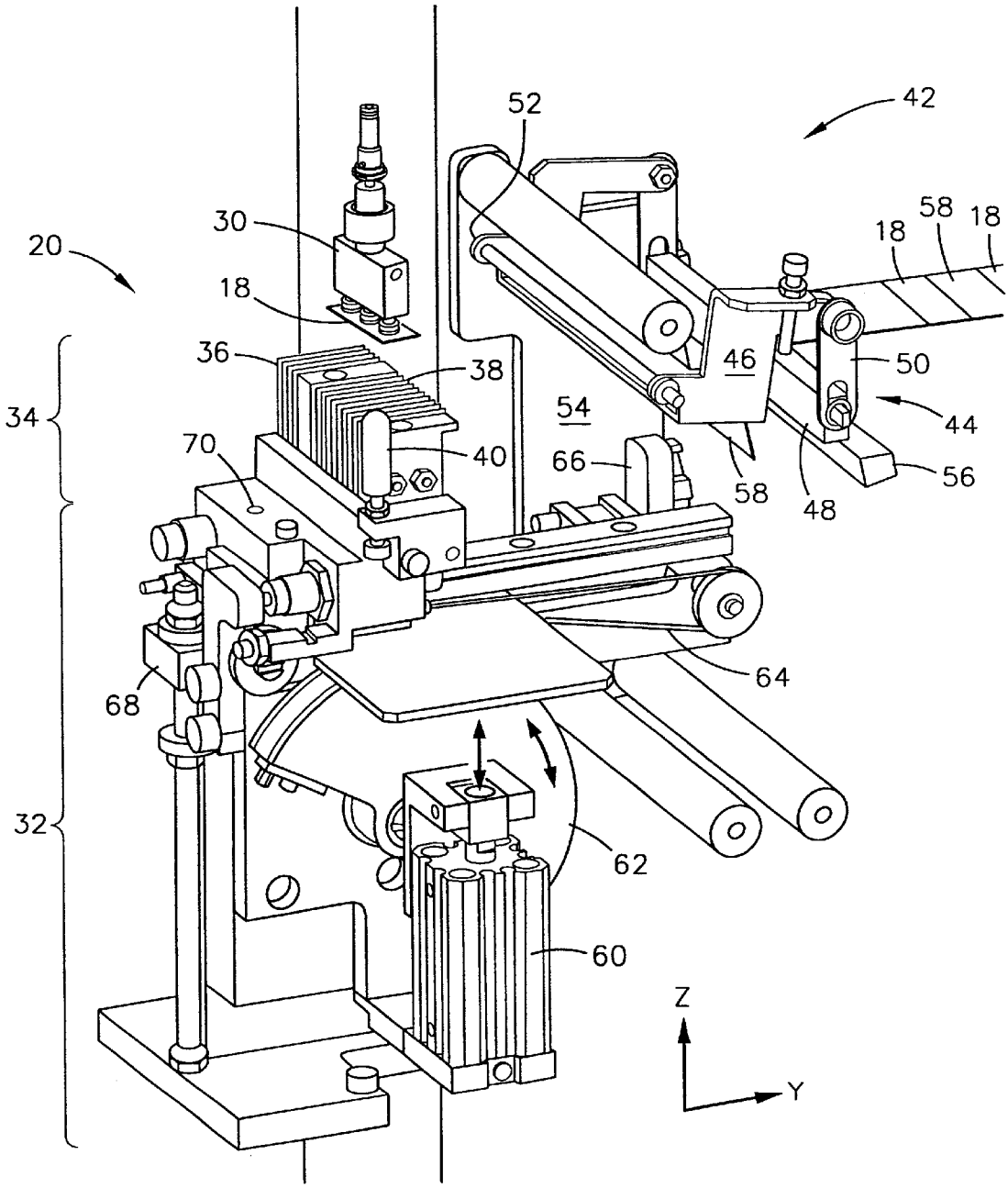
FIGS. 3A–3H are side views showing the operation of the label shuttle and clamp bar assembly.
Figure 3A:
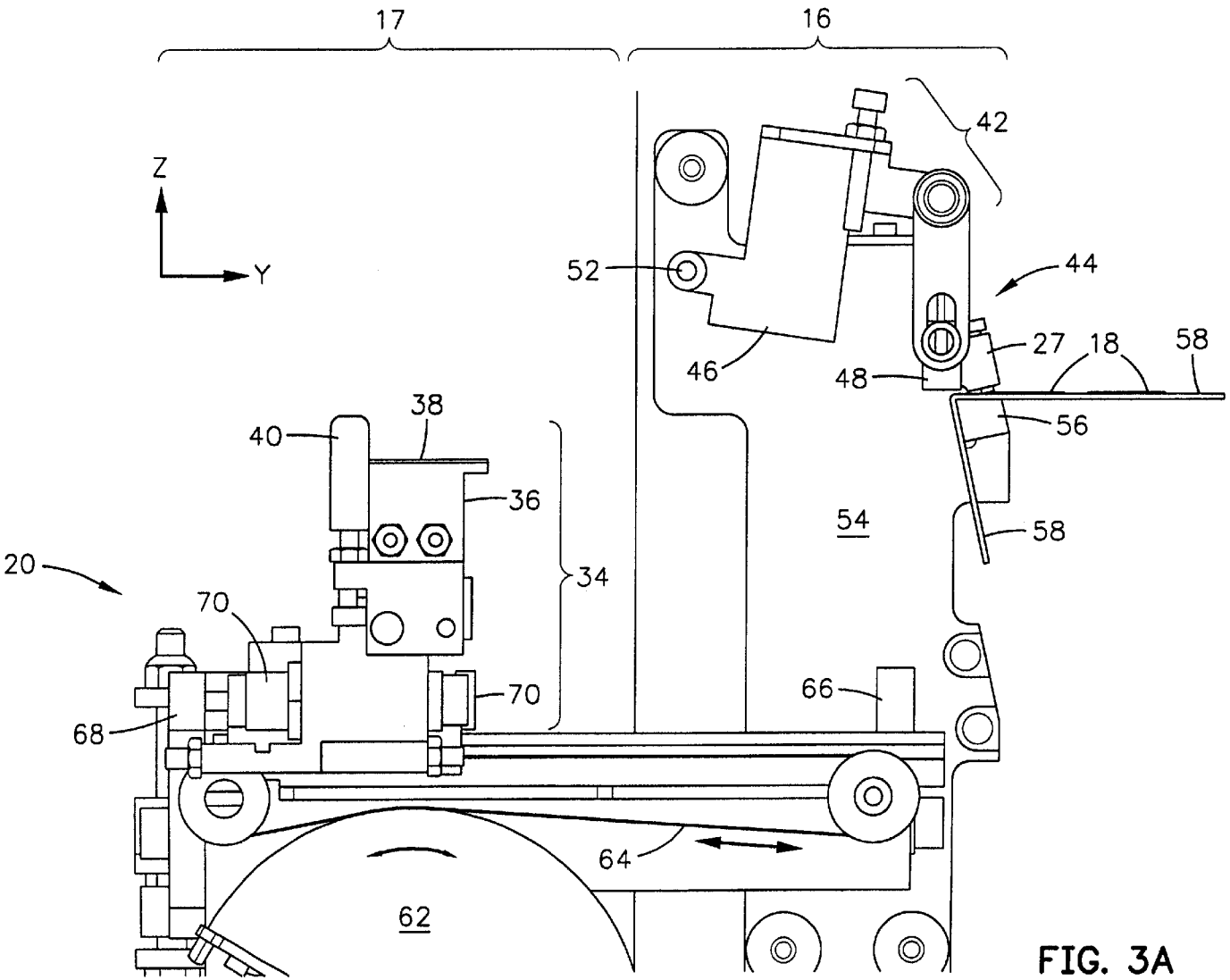
Figure 3B:
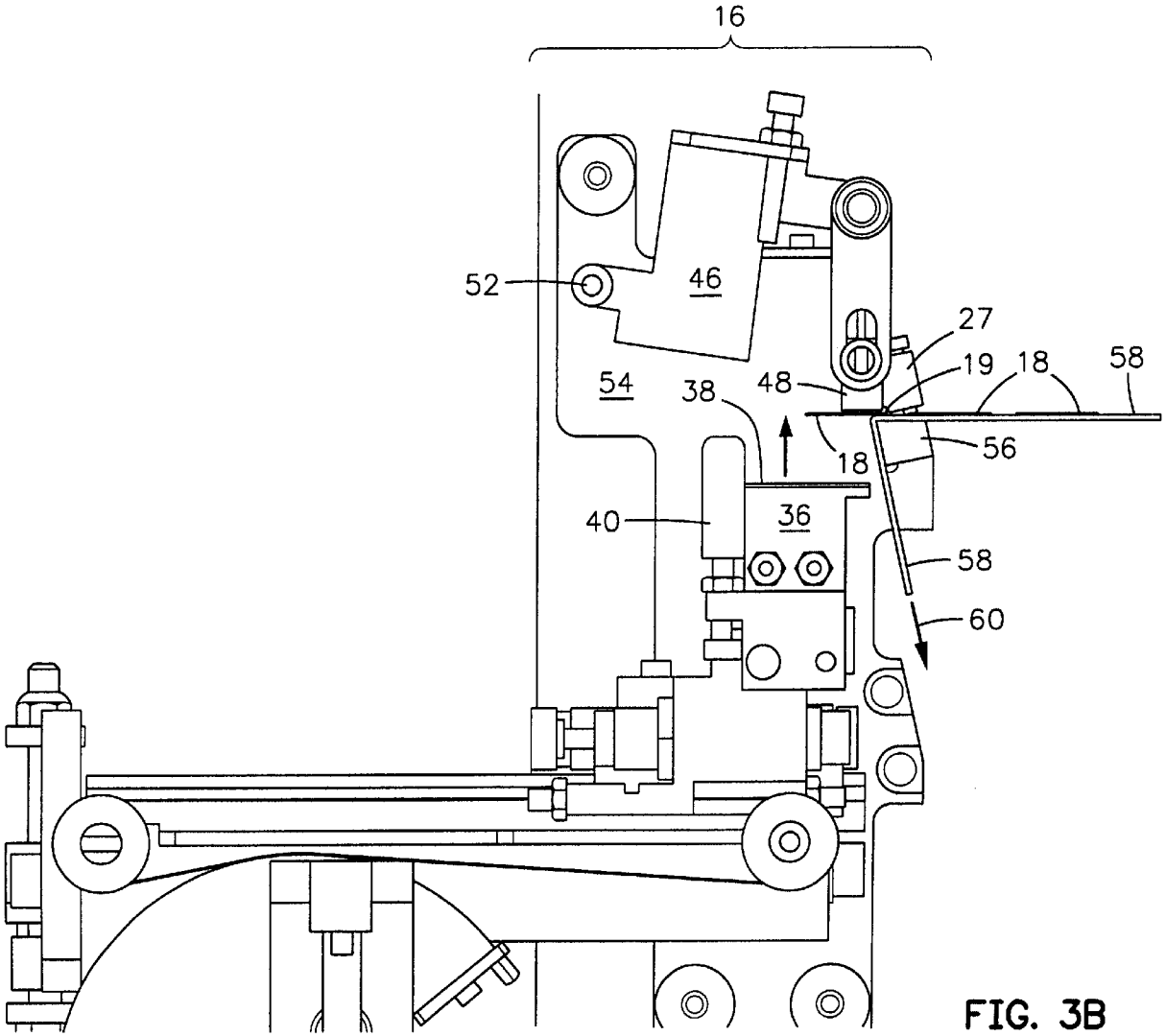
Figure 3C:
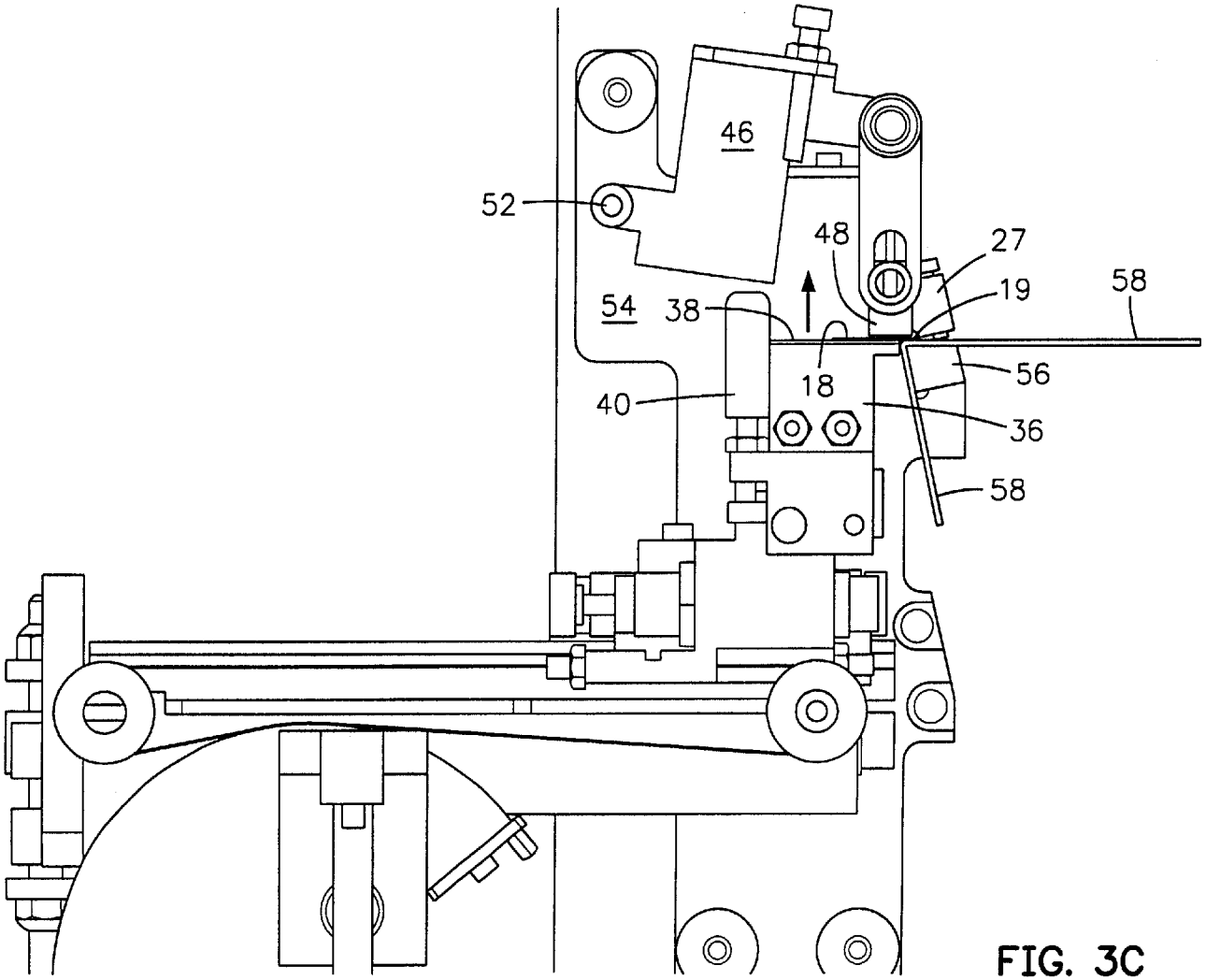
Figure 3D:
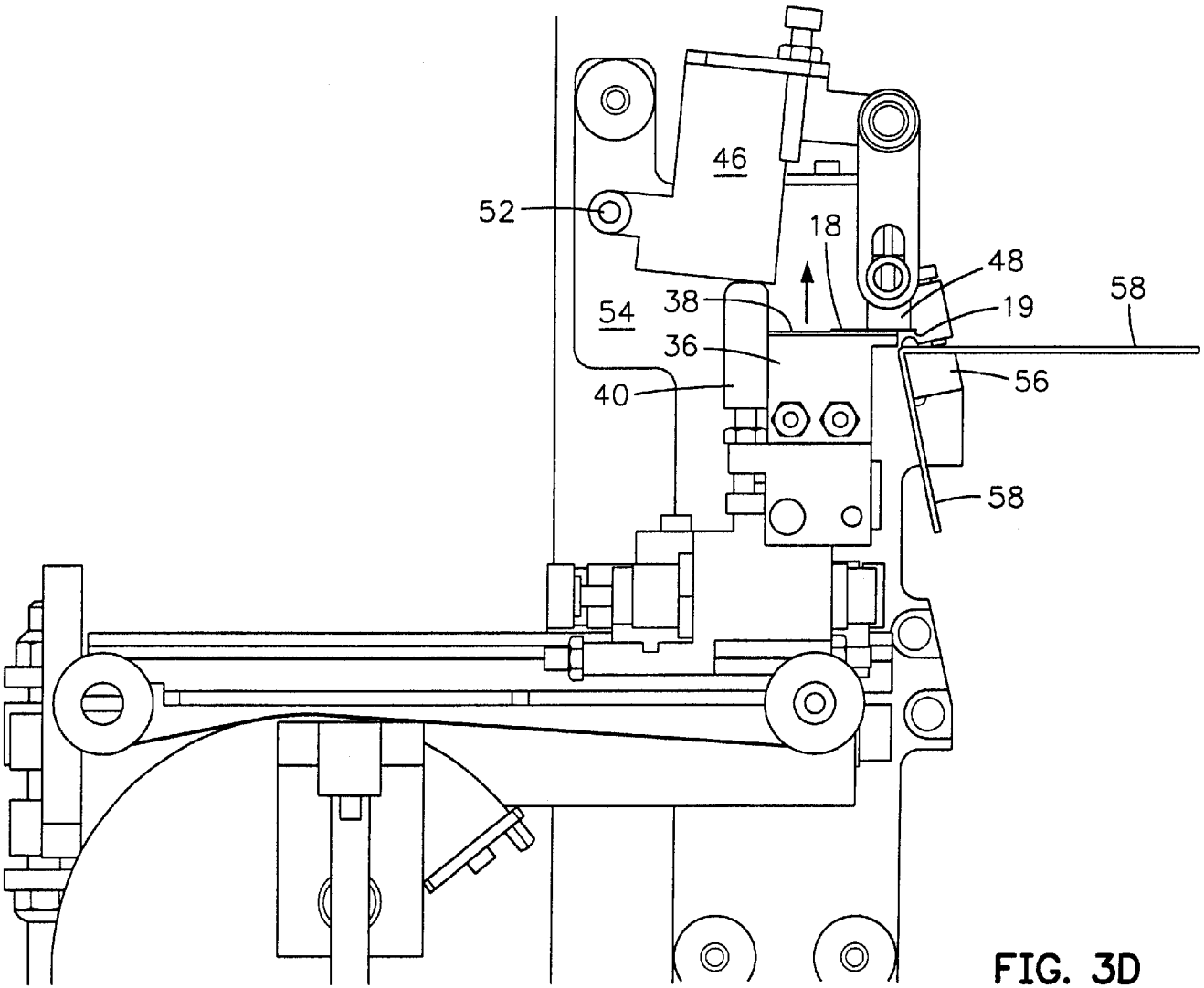
Figure 3E:
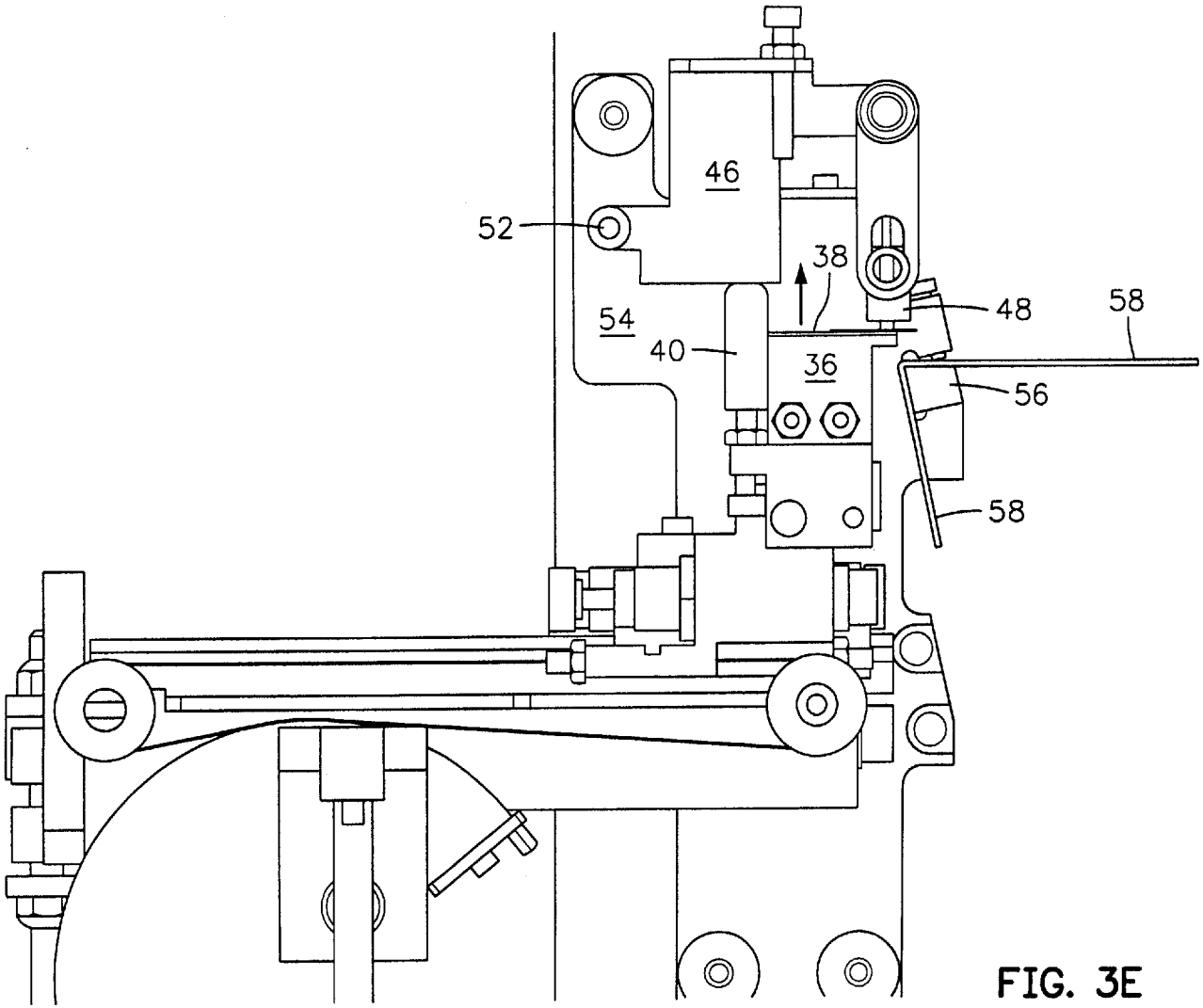
Figure 3F:
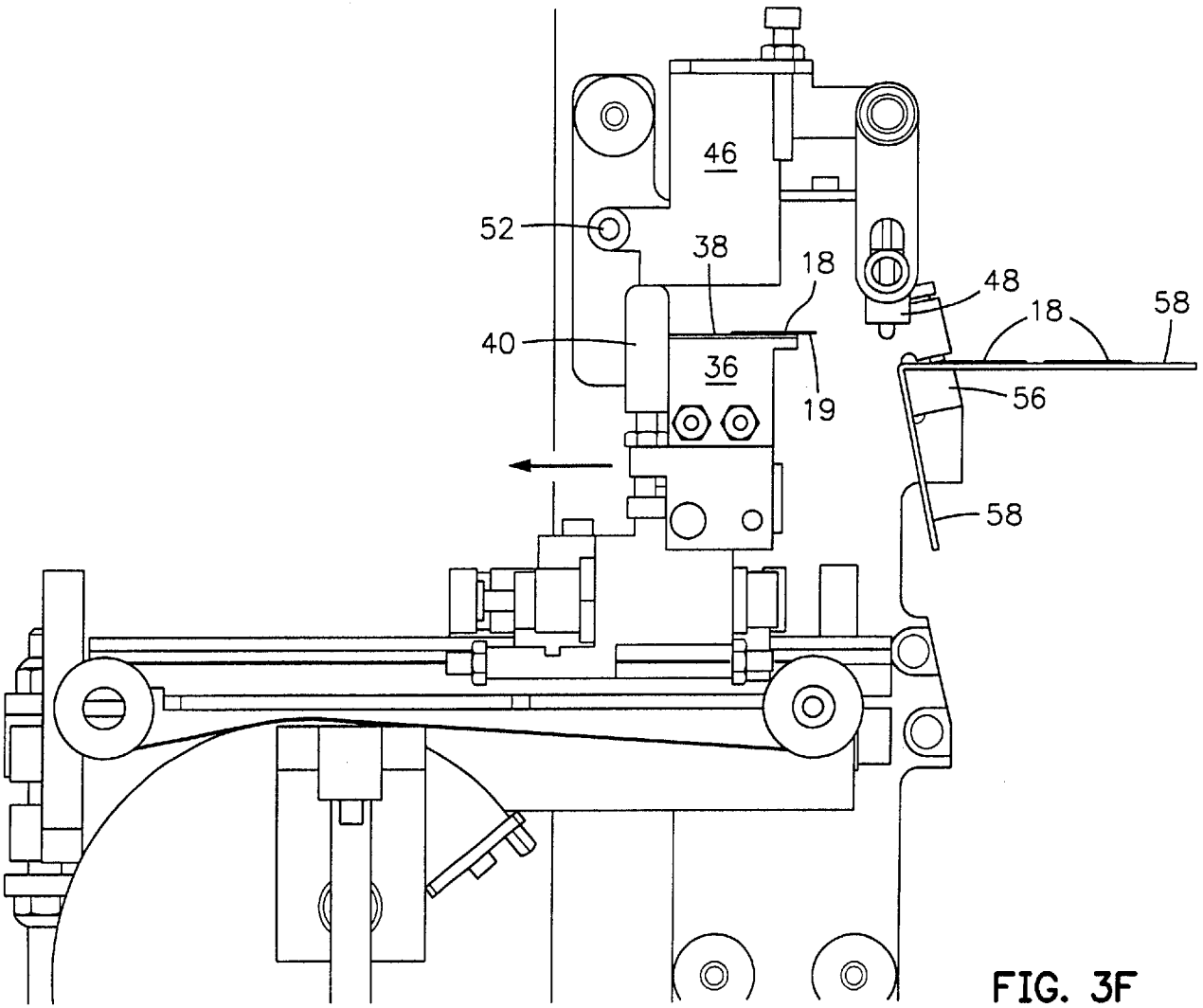
Figure 3G:
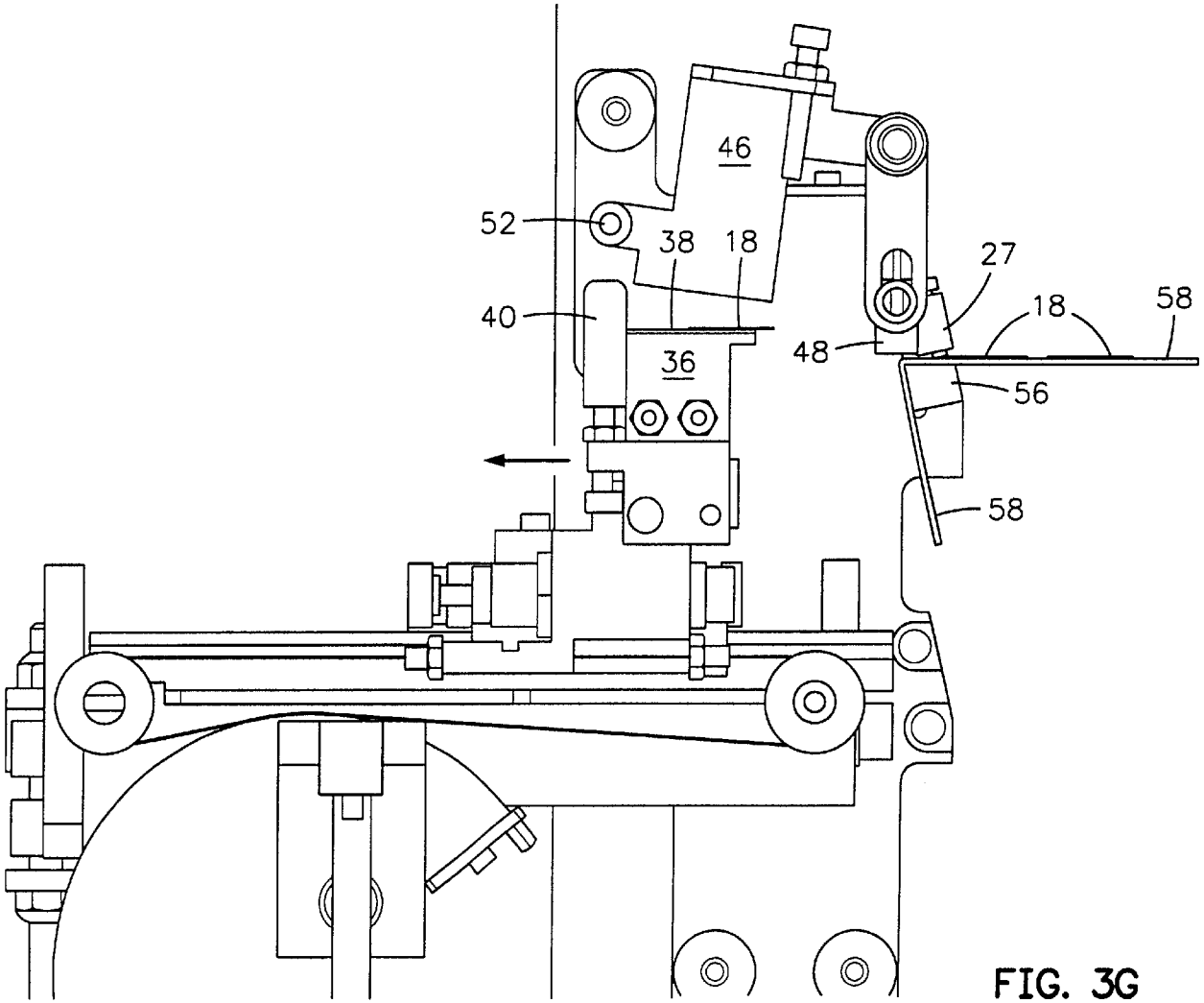
Figure 3H:
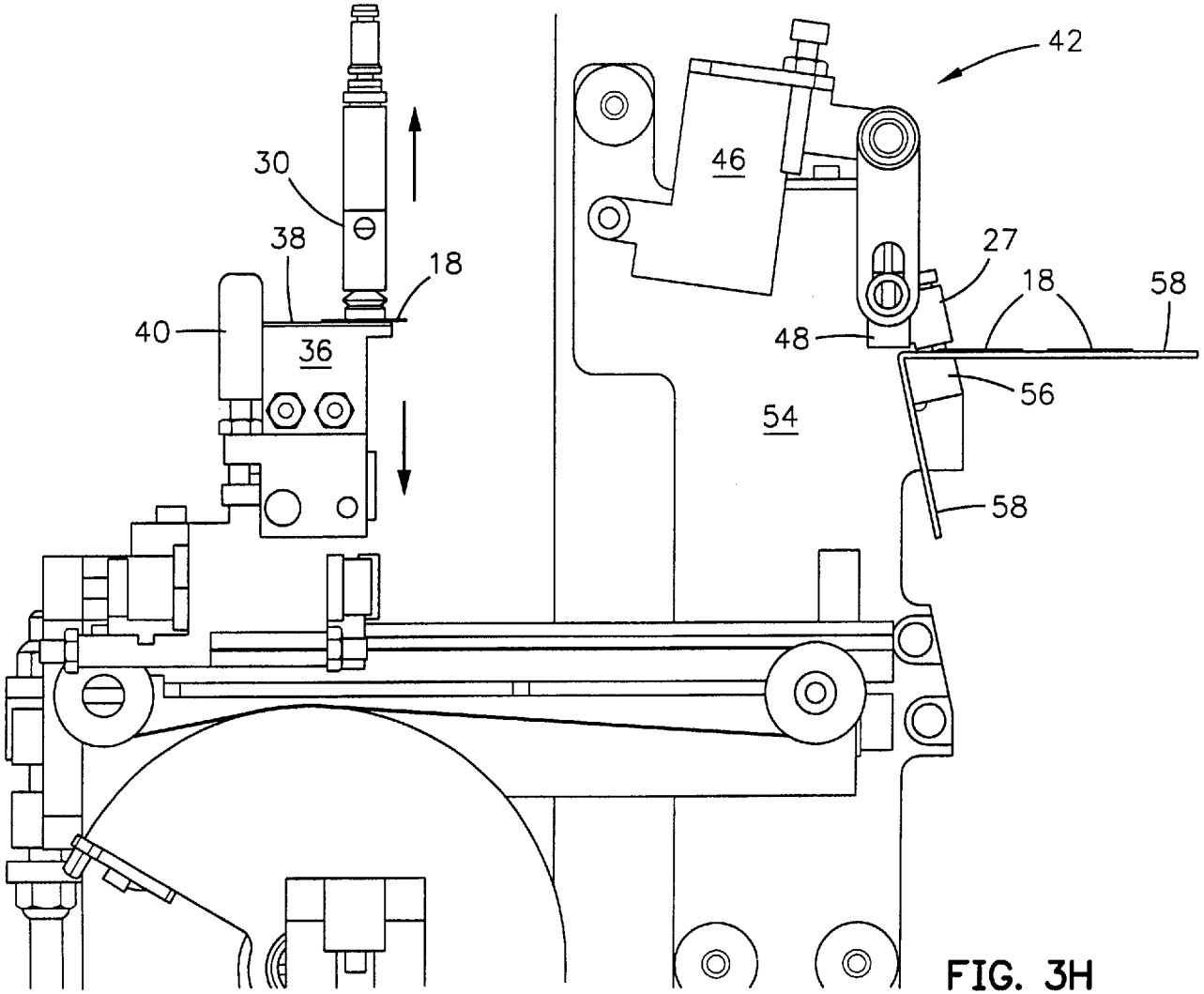

FIGS. 3A through 3H illustrate the label shuttle assembly 20 in operation. In this embodiment, the labels 18 are printed using a print head 27 positioned adjacent to the clamp bar assembly 42. In other embodiments, the labels 18 may be preprinted or a combination of printed and preprinted labels. FIG. 3A shows the label shuttle assembly 20 in a first position, which is a retracted and lowered position in the label pick up zone 17. The clamp bar 48 of the clamp bar mechanism 42 is in a lowered position and the label 18 has not been printed yet. Referring now to FIG. 3B, as the label shuttle mechanism 20 moves toward the label supply area 16, the backing tape 58 is advanced along arrow 60. As the backing tape 58 is advanced, the label 18 is printed by the printer head 27 and as it is advanced further it is partially separated from the backing tape 58 as it travels over the peel blade 56, exposing the adhesive on the lower side. Note that the label 18 is still partially attached along a trailing edge 19 to the backing tape 58. Also note that the clamp bar 48 is positioned slightly above the label 18. FIG. 3C shows the label shuttle 36 raising vertically until the label platform 38 makes contact with label 18 from underneath, contacting the adhesive on the lower side of the label 18. Note that the clamp bar 48 is not touching the label at this point. As the label shuttle 36 is lifted further, the label platform 38 lifts the label 18 into contact with the clamp bar 48. Since the clamp bar 48 is spring loaded, the clamp bar 48 exerts a downward force on the label 18, thereby clamping the label 18 tightly between the clamp bar 48 and the label platform 38 (i.e., "grabbing" or "pinching" the label). This pinching action allows the label 18 to be pulled free of the backing tape 58 while maintaining an accurate position of the label 18 on the label platform 38, as shown in FIG. 3D. In other words, the separation of the label from the liner tape does not rely on the adhesive separation between them, which might vary greatly between different labels, adhesives and backing tapes. Therefore, this method of removing a label from the backing tape would be very repeatable without regard to different labels or adhesives. Referring again to FIG. 3D, as the label shuttle 36 continues moving upward and after the label 18 is removed from the backing tape 58, the lifter bumper 40 contacts the clamp bar lifter 46 and raise the clamp bar 48 off the label 18. FIG. 3E shows the shuttle 36 in the fully raised position. The lifter bumper 40 has rotated the clamp bar lifter 46 upward, thereby raising the clamp bar 48 off of the label 18. The label 18 now adheres to the label platform 38 due to the label's adhesive on the lower side. With the label 18 adhered to the label platform 38, the label shuttle 36 moves away from the label supply 16, as shown in FIG. 3F. During this initial movement, the lifter bumper 40 remains in contact with the clamp bar lifter 46, keeping the clamp bar 48 above the label 18 until the trailing edge 19 of the label 18 is well away from the clamp bar 48. This ensures that the label 18 stays in position on the label platform 38 and is not dislodged or jarred by the clamp bar 48. FIG. 3G shows that as the label shuttle 36 continues to move away from the label supply 16, the lifter bumper 40 disengages with the clamp bar lifter 46 and the clamp bar 48 returns to it original position just above the labels 18 on the backing tape 58. At this point, the label 18 is far enough away from the clamp bar 48 that there is no contact between them. FIG. 3H shows the label shuttle 36 in the pickup zone 17. The label applicator 30 of the label placement head 14 is lowered to make contact with the label 18. The label applicator 30 is capable of releasably attaching to an upper surface of the label 18 and lifting the label 18 off the label platform 38. Most commonly this is done with a vacuum. As the label applicator 30 lifts the label off the label shuttle 36 (this step is shown in FIG. 2), the label shuttle 36 lowers into the position shown in FIG. 3A and the steps are repeated.

The label placement head 14 moves the label 18 from the label shuttle 36 to the article 24 to be labeled. The label placement head 14 may be capable of moving in the x and y direction over the article 24 to be labeled. The label placement head 14 maybe controlled by a computer. The computer may be part of the label placement machine 10. Attached to the label placement head 14 is the label applicator 30 that moves in the +/−z direction and is used to retrieve the label 18 from the label shuttle 36 and apply the label 18 to the article 24. The lower surface of the label applicator 30 typically has a plurality of holes. To retrieve a label 18 for attachment, the label applicator 30 is positioned over the label 18 on the label platform 38 and lowered to make contact with the label 18, this is shown in FIG. 3H. A vacuum pressure is generated in the holes to hold the label 18 on the label applicator 30. As the label applicator 30 is raised, the label 18 lifts off of the label platform 38. The label applicator 30 then transports the label 18 from the label shuttle 36 to the article 24. Once in position over the article 24, the label applicator 30 is lowered until the adhesive side of the label 18 is in contact with the article 24. The vacuum pressure is released and the label applicator 30 may apply pressure and secures the label 18 to the article 24. While the label placement head 14 is moving the label 18 from the label shuttle 36 to the article 24, the label shuttle 36 has repeated the steps outlined above and has retrieved another label 18 and awaits the label placement head 14 to return to the pickup zone 17.

It should be evident to those skilled in the art that, while the invention is disclosed with respect one label shuttle mechanism and clamp bar mechanism, more may be incorporated into a label placement machine. One example might be if there are a plurality of labels to be placed on an article, multiple label shuttle assemblies and label placement heads may be used, thereby decreasing the labeling time per article.

Therefore, it should be obvious that a new and improved label placement machine has been described using a label shuttle assembly in embodiments that can be readily adapted and modified by those skilled in the art without departing from the scope of the invention.

What is claimed:

1. A label placement machine used for placing labels on articles, comprising:

a label supply having one or more labels;

a label shuttle assembly for retrieving a label from the label supply and transporting the label from the label supply to a pickup zone; and a label placement head for retrieving the label from the label shuttle at the pickup zone and transporting the label from the pick up zone to the article to be labeled, the label placement head having a label attachment means for attaching the label to the article.

2. The label placement machine of claim 1, further comprising:

a clamp bar assembly positioned near the label supply, the clamp bar assembly having a pressure means capable of applying pressure contact with an upper surface of the label; and the label shuttle includes a movement means for moving the label shuttle assembly from a first position below the label to a second position above the label whereby the clamp bar assembly assists the label shuttle assembly in the retrieval of the label from the label supply.

3. The label placement machine of claim 2, further comprising:

a lifter bumper positioned on the label shuttle assembly capable of disengaging the pressure means of the clamp bar assembly after retrieval of the label from the label supply.

4. The label placement machine of claim 1 wherein the label supply includes a label printer.

5. The label placement machine of claim 1 wherein the labels are preprinted.

6. The label placement machine of claim 1 wherein the label supply includes a plurality of labels releasably attached to a backing tape.

7. The label placement machine of claim 6 wherein the label supply further includes means for partially separating a label from the backing tape.

8. The label placement machine of claim 7 wherein the means for partially separating the label from the backing tape is a peel blade positioned near the label supply.

9. The label placement machine of claim 8 wherein the label shuttle assembly has a movement means capable of moving the label shuttle assembly from a first position below the peel blade to a second position above the peel blade thereby retrieving the partially separated label.

10. The label placement machine of claim 9, further comprising:

a clamp bar assembly positioned above the peel blade, the clamp bar assembly having a spring loaded clamp bar capable of applying pressure contact with an upper surface of the label that is partially separated whereby the clamp bar assembly assists the label shuttle in the retrieval of the label.

11. The label placement machine of claim 1 further comprising:

a conveyor means for transporting the articles through the label placement machine.

12. The label placement machine of claim 11 wherein the label pickup zones is located near a side of the conveyor means.

13. The label placement machine of claim 1 wherein the label placement head includes a vacuum pressure.

14. A method of applying labels to an article using a label placement machine, comprising the steps of:

providing one or more labels in a label supply area, the labels having a backing tape;

partially separating the label from the backing tape thereby partially exposing an adhesive surface of the label;

positioning a label shuttle assembly near the adhesive surface of the label;

positioning a clamp bar assembly near the label opposite the adhesive surface of the label;

moving the label shuttle assembly into contact with the adhesive surface of the label with continued movement of the label shuttle assembly urging the label into contact with the clamp bar assembly, the clamp bar assembly supply a pressure force on the label to releasably attach the adhesive surface of the label to the label shuttle assembly and in combination fully separating the label from the liner tape;

disengaging the pressure force of the clamp bar assembly from the label;

moving the label shuttle assembly to a pickup zone;

retrieving the label from the label shuttle with a label applicator head;

moving the label applicator head to the article to be labeled; the adhesive side of the label contacting the article; and lowering the label applicator head to the article attaching the label to the article.

15. The method of applying labels in claim 14, wherein the disengaging the pressure force of the clamp bar assembly from the label is a lifter bumper positioned on the label shuttle assembly that engages and moves the clamp bar assembly away from the label.

16. The method of applying labels in claim 14 wherein the one or more labels are preprinted labels.

17. The method of applying labels in claim 14 further comprising the step of:

printing the one or more labels with an onboard printer.

18. The method in claim 14 further comprising the step of:

conveying the articles to the labeled on a conveyor belt.

19. The method in claim 14 further comprising the step of:

retrieving another label with the label shuttle assembly as the label applicator head moves and attaches the label to the article.

20. A method of using a label shuttle assembly with an existing label placement machine for attaching a label to an article, the existing label placement machine having a label supply and a label placement head, comprising the steps of:

integrating the label shuttle assembly with the existing label placement machine, the label shuttle assembly including a movable label shuttle and a clamp bar assembly;

retrieving a label from the label supply area with the label shuttle and clamp bar assembly;

moving the label with the label shuttle to a label placement head pickup zone;

retrieving the label from the label shuttle with the label placement head;

returning the label shuttle to the label supply while the label placement head moves to the label to the article retrieving another label from the label supply area with the label shuttle and clamp bar assembly while the label placement head attaches the label to the article; and moving the label shuttle with the another label to the pickup zone.

* * * * *